US007764804B2

(12) United States Patent
Ohta et al.

(10) Patent No.: US 7,764,804 B2
(45) Date of Patent: Jul. 27, 2010

(54) PANEL-TYPED LOUD SPEAKER AND AN EXCITER THEREFOR

(75) Inventors: Yoshizumi Ohta, Fujiyoshida (JP); Kazuhiro Kobayashi, Fujiyoshida (JP)

(73) Assignee: Citizen Electronics Co., Ltd., Fujiyoshida-shi, Yamanashi-ken (JP)

( * ) Notice: Subject to any disclaimer, the term of this patent is extended or adjusted under 35 U.S.C. 154(b) by 999 days.

(21) Appl. No.: 11/514,652

(22) Filed: Sep. 1, 2006

(65) Prior Publication Data

US 2007/0053531 A1 Mar. 8, 2007

(30) Foreign Application Priority Data

Sep. 5, 2005 (JP) ..... 2005-255963

(51) Int. Cl.
*H04R 25/00* (2006.01)

(52) U.S. Cl. ..... 381/190; 381/152

(58) Field of Classification Search ..... 381/150, 381/151, 152, 186, 190, 337, 386, 396, 398; 310/322, 324, 326, 354; 181/150, 157, 161, 181/173

See application file for complete search history.

(56) References Cited

U.S. PATENT DOCUMENTS

2005/0116585 A1 6/2005 Yonetake et al.
2006/0104171 A1 5/2006 Kobayashi et al.
2006/0140424 A1 6/2006 Kobayashi

FOREIGN PATENT DOCUMENTS

JP 2005-160028 6/2005

*Primary Examiner*—Brian Ensey
(74) *Attorney, Agent, or Firm*—Brinks Hofer Gilson & Lione

(57) ABSTRACT

An exciter for a panel-type loud speaker comprises a bimorph and a bimorph holding member. The bimorph comprises a plate member and a pair of piezoelectric ceramic layers, each formed on the opposite sides of the plate member. The bimorph holding member is holds one end of the bimorph and comprises a bimorph end holding portion for holding the one end of the bimorph, which comprises a three-layer embedded section embedding the pair of piezoelectric ceramic layers and the plate member sandwiched therebetween at the one end of the bimorph, and an extension embedded section in which an extension of the plate member is embedded, and a mounting protrusion protruding from the bimorph end holding portion, wherein a distal end of the mounting protrusion is connected to the diaphragm so that the bimorph is disposed on the diaphragm with a space interposed between the bimorph and the diaphragm.

12 Claims, 3 Drawing Sheets

PANEL-TYPED LOUD SPEAKER AND AN EXCITER THEREFOR

This application claims priority under 35 U.S.C. §119 to Japanese Patent Application No. JP2005-255963 filed Sep. 5, 2005, the entire content of which is hereby incorporated by reference.

BACKGROUND

The present invention relates to a panel-type loud speaker to be used in a small-size portable device, such as a cellular phone and an exciter used in such a panel-type loud speaker.

DESCRIPTION OF BACKGROUND ART

In recent years, a small-size portable device provided with a liquid crystal display, such as a cellular phone, has employed a panel-type loud speaker, in which the panel-type loud speaker comprises a transparent panel serving as a diaphragm thereof which also serves as a protection panel for the liquid crystal display so that a sound generated by the loud speaker can be felt to be emitted from an image appearing on the liquid crystal display. Many of the panel-type loud speakers employ a piezoelectric exciter for vibrating the diaphragm thereof [see Japanese Patent Application Publication No. 2005-160028].

FIG. 5 shows an exemplary structure of a box-type of piezoelectric exciter in which piezoelectric elements b1 and b2 are supported in a casing C in a cantilever manner. Specifically, the piezoelectric elements b1 and b2 are of a type of bimorph which comprises a thin elongated metal plate and piezoelectric ceramic layers formed on the opposite sides of the metal plate. The casing has a pair of chambers and the piezoelectric elements or bimorphs are accommodated in the corresponding chambers and are held with their left ends (as viewed in FIG. 5) clamped between and adhesively secured to upper and lower wall surfaces of the respective chambers. Reference f in FIG. 5 indicates adhesive layers.

The box-type piezoelectric exciter is mounted on a diaphragm or panel of a panel-type loud speaker (not shown) by attaching an upper or lower surface thereof to the diaphragm. When an acoustic signal voltage is applied to the bimorphs b1 and b2 through terminals t1 and t2, the bimorphs are vibrated, whereby the diaphragm is vibrated to generate sound.

FIG. 6 is a partially enlarged sectional view showing another box-type piezoelectric exciter that is different from that shown in FIG. 5 in that the casing C supports the bimorph b1 only by securely holding an extension of the metal plate which is positioned in the left end of the bimorph and extends leftward beyond the piezoelectric ceramic layers sandwiching the metal plate. The bimorph is applied with an acoustic signal voltage through the terminal t1 and the terminal t2, i.e., the tip end of the extension of the metal plate.

Although the panel-type loud speaker can successfully achieve high acoustic pressures by taking advantage of a plurality of resonant points each of the cantilevered bimorph and the diaphragm, in regions between some successive resonance points, the acoustic pressure substantially drops to thereby make the sound generated by the panel-type loud speaker unsatisfactory for a user.

Specifically, as indicated by a solid line in FIG. 7, the acoustic pressure of sound generated by a panel-type loud speaker with the exciter as shown in FIG. 5 is generally satisfactory for a lower band (lower than 1 kHz) but substantially drops locally for a higher band.

On the other hand, as indicated by a chain line in FIG. 7, the acoustic pressure of sound generated by a panel-type loud speaker with the exciter as shown in FIG. 6 is generally satisfactory for the higher band but not for the lower band.

SUMMARY OF THE INVENTION

In the light of the circumstances as described above, an object of the present invention is to provide an exciter for a panel-type loud speaker which will make it possible to prevent the substantial drops in the acoustic pressure as stated above and to provide a panel-type loud speaker with the exciter.

An exciter for a panel-type loud speaker according to one aspect of the present invention comprises a bimorph and a bimorph holding member. The bimorph comprises an elongated plate member and a pair of elongated piezoelectric ceramic layers formed on the opposite sides of the plate member. The bimorph has one end in the longitudinal direction thereof wherein the plate member has an extension longitudinally extending beyond the pair of piezoelectric ceramic layers sandwiching the plate member therebetween. The bimorph holding member comprises: a three-layer embedded section which embeds therein the pair of the piezoelectric layers and the plate member sandwiched therebetween in the one end of the bimorph, and, an extension embedded section which embeds therein the extension of the plate member except for the tip end thereof, and a mounting protrusion projecting from the extension embedded section. The mounting protrusion has a proximal end positioned apart from the three-layer embedded section by a predetermined distance and adjacent the tip end of the extension of the plate member, and a distal end adapted to be connected to a diaphragm of a panel-type loud speaker so that the bimorph is positioned with a space interposed between the diaphragm and the bimorph end holding portion.

In the exciter 1, the resonant frequencies in higher and lower frequency ranges are controlled or attenuated by the three-layer embedded section and the extension embedded section to thereby enable the frequency characteristic of the acoustic pressure of the panel-type loud speaker to be improved.

Preferably, the exciter may further comprise a yieldable member placed between and in contact with the three-layer embedded section and the diaphragm in order to improve impact-resistant property as well as the frequency characteristic.

In addition, the distal end portion of the mounting protrusion may comprise a plate-shaped portion adapted to be fixed to the diaphragm such that the plate-shaped portion extends in parallel with the bimorph end holding portion and the bimorph.

In this case again, preferably a yieldable member may be placed between and in contact with the three-layer embedded section and the plate-shaped portion.

Further, an exciter for a panel-type loud speaker according to a second aspect of the present invention comprises a bimorph and a bimorph holding member. The bimorph comprises an elongated plate member and a pair of elongated piezoelectric ceramic layers formed on the opposite sides of the plate member. The bimorph has one end in the longitudinal direction thereof wherein the plate member has an extension longitudinally extending beyond the pair of piezoelectric ceramic layers sandwiching the plate member therebetween. The bimorph holding member comprises: a three-layer embedded section which embeds therein the pair of the piezoelectric layers and the plate member sandwiched therebetween in the one end of the bimorph, an extension embedded section which embeds therein the extension of the plate member except for the tip end thereof, a flange portion extending radially outwardly and circumferentially around the extension embedded section such that the flange portion is positioned apart from the three-layer embedded section and adjacent to a tip end of the extension, and a rectangular cylindrical portion extending from an outer peripheral edge of the flange portion toward the other end of the bimorph in the longitudinal direction thereof with a rectangular cylindrical space between the rectangular cylindrical portion and the extension embedded section, the three-layer embedded section, and the bimorph, the rectangular cylindrical portion being adapted to be fixed to a diaphragm.

This exciter, like the first exciter as described above, will enable the frequency characteristic of acoustic pressure of the panel-typed loud speaker to be improved by means of the bimorph end holding portion.

In addition, this exciter may also comprise a yieldable member placed between and in contact with the three-layer embedded section and an interior wall surface of the cylindrical portion.

In a third aspect of the present invention, there is provided a panel-type loud speaker comprising a flat diaphragm and an exciter attached to the diaphragm. The exciter comprises a bimorph and a bimorph holding member. The bimorph comprises an elongated plate member and a pair of elongated piezoelectric ceramic layers formed on the opposite sides of the plate member. The bimorph has one end in the longitudinal direction thereof wherein the plate member has an extension longitudinally extending beyond the pair of piezoelectric ceramic layers sandwiching the plate member therebetween. The bimorph holding member comprising a bimorph end holding portion for holding said one end of said bimorph, an extension embedded section embedding therein the extension of the plate member except for the tip end thereof, and a mounting protrusion projecting from the extension embedded section. Furthermore, the bimorph end holding portion comprises a three-layer embedded section embedding therein the pair of the piezoelectric layers and the plate member sandwiched by the piezoelectric layers at the one end of the bimorph. The mounting protrusion has a proximal end positioned apart from the three-layer embedded section by a predetermined distance and adjacent the tip end of the extension and a distal end adapted to be connected to a diaphragm of a panel-type loud speaker so that the bimorph is positioned with a space interposed between the diaphragm and the bimorph.

This loud speaker may also comprise a yieldable member placed between and in contact with the three-layer embedded section and the diaphragm.

In addition, the distal end of the mounting protrusion may comprise a plate-shaped portion adapted to be fixed to the diaphragm such that the plate-shaped portion extends in parallel with and with some space apart from the bimorph end holding portion and the bimorph.

In this case again, the loud speaker may further comprise a yieldable member placed between and in contact with the three-layer embedded section and the plate-shaped portion.

The present invention further provides a panel-type loud speaker comprising a flat diaphragm and an exciter attached to the diaphragm. The exciter comprises a bimorph and a bimorph holding member. The bimorph comprises an elongated plate member and a pair of elongated piezoelectric ceramic layers formed on the opposite sides of the plate member. The bimorph has one end in the longitudinal direction thereof wherein the plate member has an extension longitudinally extending beyond the pair of piezoelectric ceramic layers sandwiching the plate member therebetween. The bimorph holding member comprises a bimorph end holding portion for holding said one end of said bimorph, which comprises a three-layer embedded section which embeds therein the pair of the piezoelectric layers and the plate member sandwiched therebetween at the one end of the bimorph, an extension embedded section which embeds therein the extension of the plate member except for the tip end thereof, a flange portion extending circumferentially around the extension embedded section such that the flange portion is positioned apart from the three-layer embedded section and adjacent to a tip end of the extension, and a rectangular cylindrical portion extending from an outer peripheral edge of the flange portion toward the other end of the bimorph in the longitudinal direction thereof with a rectangular cylindrical space between the rectangular cylindrical portion and the extension embedded section, the three-layer embedded section, and the bimorph, the rectangular cylindrical portion being adapted to be fixed to a diaphragm.

A yieldable member may be placed between and in contact with the three-layer embedded section and an interior surface of the rectangular cylindrical portion.

According to the present invention, it becomes possible to improve the frequency characteristic of the acoustic pressure by attenuating resonant vibrations in a higher acoustic range and a lower acoustic range with the aid of the bimorph holding member employed in the present invention comprising the three-layer embedded section and the extension embedded section.

DETAILED DESCRIPTION OF THE PREFERRED EMBODIMENTS

Preferred embodiments of the present invention will be described with reference to the attached drawings.

Figure 1:
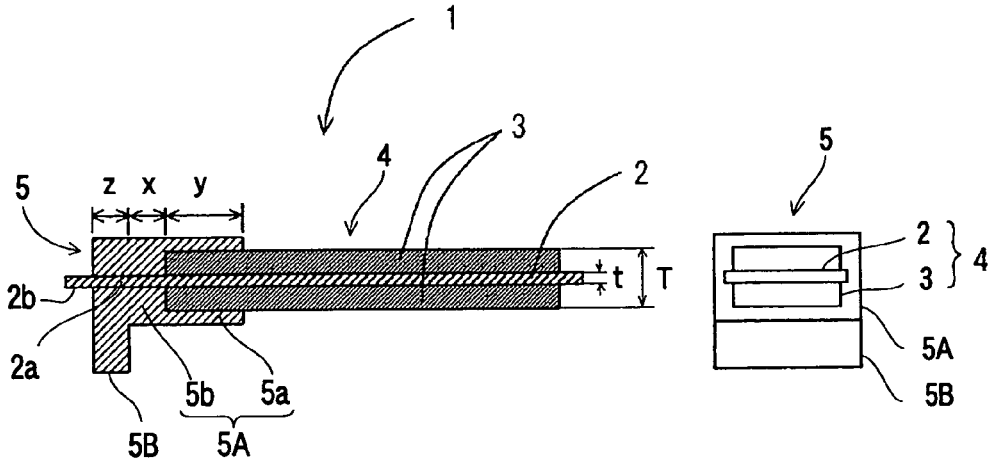
FIG. 1 is a sectional front view and a right side elevation view of an exciter for a panel-type loud speaker according to a first embodiment of the present invention.

Referring first to FIG. 1, an exciter 1 for a panel-type loud speaker according to the first embodiment of the present invention comprises a bimorph 4 and a bimorph holding member 5 made of resin which is integrally formed with the bimorph 4 by an insert molding and holds the bimorph 4 in a cantilever manner.

The bimorph 4 comprises an elongated plate member 2 that may be made of metal, resin or ceramic and a pair of elongated piezoelectric ceramic layers 3 formed on opposite sides of the plate member. The plate member 2 in its peripheral region extends outward beyond the piezoelectric ceramic layers 3.

The bimorph holding member 5 comprises a bimorph end holding portion 5A and a mounting portion or protrusion 5B protruding from the bimorph end holding portion 5A. The bimorph end holding portion 5A includes a three-layer embedded section 5*a* which embeds therein the pair of piezoelectric ceramic layers 3 and the plate member 2 sandwiched therebetween in the left end (as viewed in FIG. 1) of the bimorph 4, and an extension embedded section 5*b* which embeds therein an extension 2*a* of the plate member 2, which is positioned in left end of said bimorph and extends longitudinally or leftward beyond the pair of piezoelectric ceramic layers sandwiching the plate member therebetween, except for a tip end of the extension 2*a*.

The mounting protrusion 5B comprises a proximal end connected to the extension embedded section 5*b* at a position longitudinally apart from the three-layer embedded section 5*a* by a predetermined distance "x" and adjacent to the tip end 2*b* of the extension 2*a* of the plate member 2, and a distal end adapted to be connected to a diaphragm of a panel-type loud speaker so that the bimorph is positioned with a space interposed between the bimorph and the diaphragm. The holding member 5 may be made of metal and, when the plate member 2 is made of metal, insulation must be provided in the interface between the holding member 5 and the plate member 2. It has been found that the frequency characteristic of the acoustic pressure can be improved by satisfying the following formulas:

$$T<z, \quad (1)$$

$$t<x<2T, \text{ and} \quad (2)$$

$$T<y<5T \quad (3)$$

wherein, "y" denotes a size of the three-layer embedded section 5*a*, "z" denotes a size of the mounting protrusion 5B, both measured along the longitudinal axis of the bimorph 4, "t" denotes a thickness of the plate member, and "T" denotes a thickness of three-layer portion.

Figure 2:
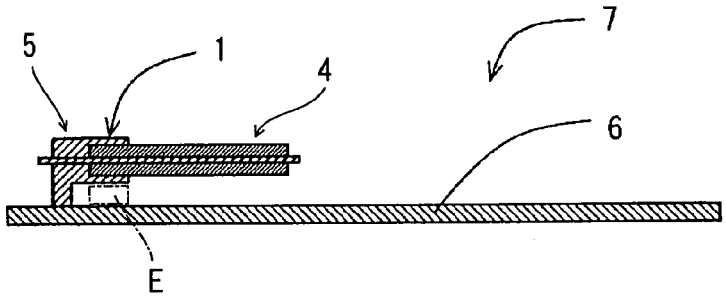
FIG. 2 is a sectional front view of a panel-type loud speaker using the exciter of FIG. 1.

FIG. 2 shows a panel-type loud speaker 7 having a diaphragm 6 on which the exciter 1 of FIG. 1 is securely attached. The diaphragm 6 is in a rectangular shape and may be made of a plastic or metal sheet. The exciter 1 is disposed on the diaphragm 6 such that the distal end of the mounting protrusion 5B of the bimorph holding member 5 is securely attached to the diaphragm 6 at a position near the left edge (as viewed in FIG. 2) of the diaphragm by means of bonding, welding or adhesion, and the bimorph end holding portion 5A and the bimorph 4 extends in parallel with the diaphragm 6 with a space interposed between the diaphragm 6 and the bimorph 4. It is preferred that from the viewpoint of improving the impact-resistant property of the exciter, a yieldable member E, such as sponge and rubber having elasticity, is disposed in the space between the diaphragm 6 and the bimorph end holding portion 5A, and in particular, between the three-layer embedded section 5*a* and the diaphragm 6, as illustrated, in order to improve the frequency characteristic as mentioned above.

Figure 7:
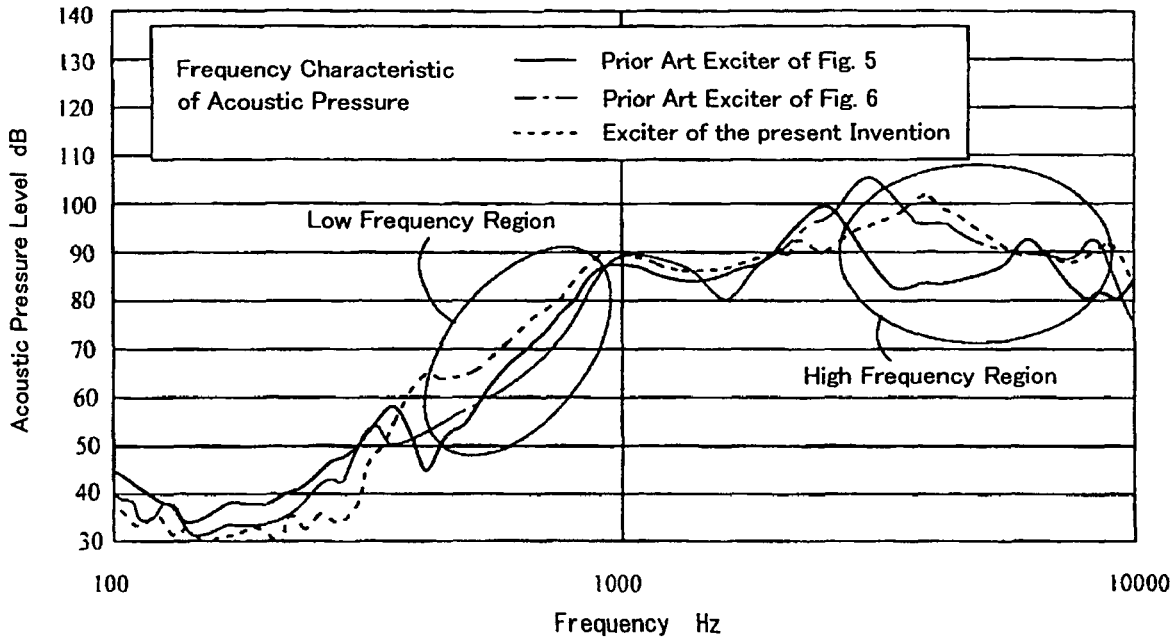
FIG. 7 is a graphical representation indicating frequency characteristics of acoustic pressure of a panel-type loud speaker.

In the exciter 1, the resonant frequencies in higher and lower frequency ranges are controlled by the three-layer embedded section 5*a* and the extension embedded section 5*b*, so that the resultant frequency characteristic curve will become smooth, as shown by a dotted line in FIG. 7, as compared with that of the prior art exciters as stated above.

Figure 3:
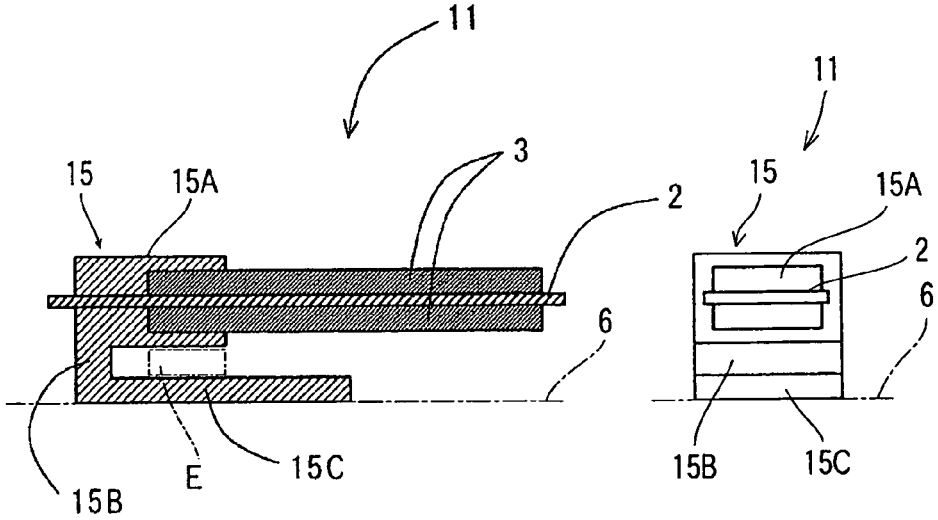
FIG. 3 is a sectional front view and a right side elevation view of an exciter for a panel-type loud speaker according to a second embodiment of the present invention.

FIG. 3 shows an exciter 11 for a panel-type loud speaker in accordance with the second embodiment of the present invention.

Although the exciter 11 comprises a bimorph holding member 15 including a bimorph end holding portion 15A and a mounting protrusion 15B like the exciter 1 of FIG. 1, the mounting protrusion 15B is additionally provided with a plate-shaped portion 15C extending in parallel with the bimorph 4, which is adapted to be adhesively secured to the diaphragm 6. The plate-shaped portion 15C can facilitate and enhance the adhesion of the exciter 1 to the diaphragm 6. As in the first embodiment, it is preferable to place a yieldable member E, such as sponge and rubber in a space between the plate-shaped portion 15C and the bimorph end embedded section 15A.

Figure 4:
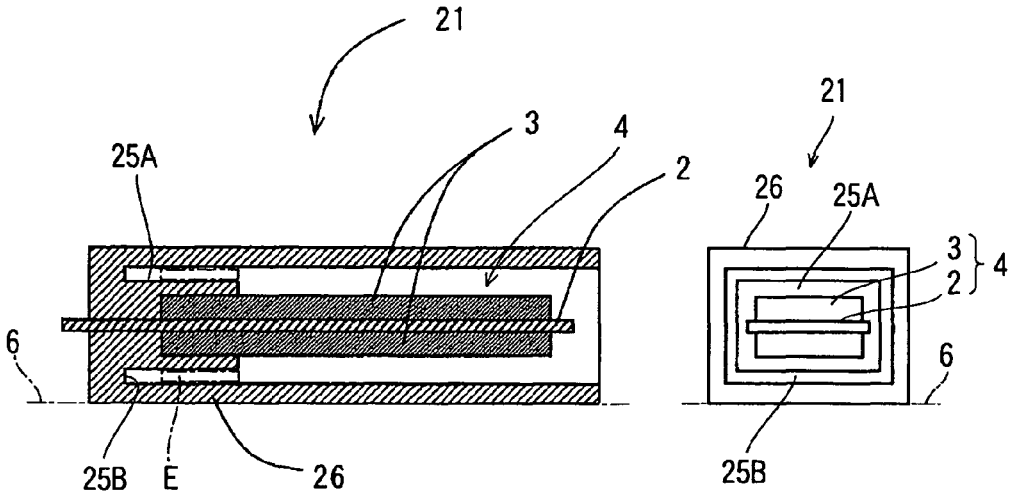
FIG. 4 is a sectional front view and a right side elevation view of an exciter for a panel-type loud speaker according to a third embodiment of the present invention.
Figure 5:
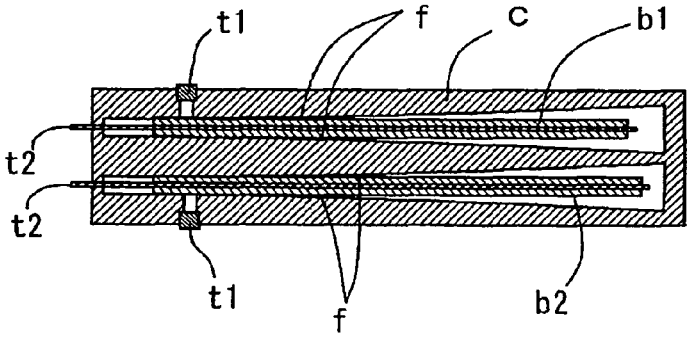
Fig. 5 Prior Art
FIG. 5 is a sectional front view of an exciter for a panel-type loud speaker of a prior art.
Figure 6:
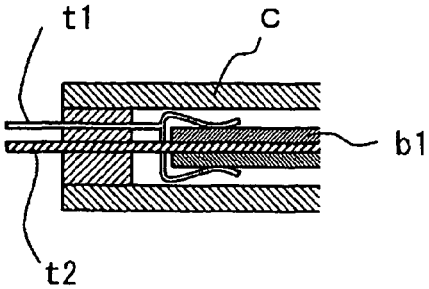
Fig. 6 Prior Art
FIG. 6 is a sectional view showing a part of an exciter for a panel-type loud speaker of another prior art.

FIG. 4 shows an exciter 21 for a panel-type loud speaker according to the third embodiment of the present invention.

Although the exciter 21 comprises a bimorph holding member 21 including the bimorph end embedded section 25A like the exciter 1 of FIG. 1, the exciter 25 comprises, instead of a mounting protrusion 5B of the exciter 1, a flange portion 25B extending radially outwardly from the left end (as viewed in FIG. 4) of the bimorph end embedded section 25A, and a rectangular cylindrical portion 26 extending rightward from the outer peripheral edge of the flange portion 25B over the right end of the bimorph with a rectangular cylindrical space interposed between the rectangular cylindrical portion 26 and the bimorph end holding portion and the bimorph. It is also preferable to place a yieldable member E in an annular space between an internal wall surface of the rectangular cylindrical portion 26 and the bimorph end embedded section 25A.

The foregoing formulas (1), (2), and (3) are applicable to those exciters 11 and 21 as shown in FIGS. 3 and 4.

Although the present invention has been described in terms of specific embodiments, it is anticipated that alternations and modifications thereof will no doubt become apparent to those skilled in the art. It is therefore intended that the following claims be interpreted as covering all such alternations and modifications as fall within the true spirit and scope of the invention.

The invention claimed is:

1. An exciter for a panel-type loud speaker, comprising:

a bimorph and a bimorph holding member, said bimorph comprising:

an elongated plate member having opposite sides; and a pair of elongated piezoelectric ceramic layers, each formed on said opposite sides of said plate member, wherein said plate member includes an extension which is positioned in one end of said bimorph in a longitudinal direction thereof and extends longitudinally beyond said pair of piezoelectric ceramic layers sandwiching said plate member therebetween;

said bimorph holding member comprising:

a bimorph end holding portion for holding said one end of said bimorph, which comprises:

a three-layer embedded section embedding said pair of piezoelectric ceramic layers and said plate member sandwiched therebetween at said one end of said bimorph, and an extension embedded section in which said extension of said plate member is embedded except for a tip end thereof, which extends out of the extension embedded section; and a mounting protrusion protruding from said bimorph end holding portion, wherein said mounting protrusion comprises:

a proximal end connected to said extension embedded section at a position longitudinally apart from said three-layer embedded section by a predetermined distance and adjacent to said tip end of said extension of said plate member, and a distal end adapted to be connected to a diaphragm of a panel-type loud speaker so that said bimorph is positioned with a space interposed between said bimorph and said diaphragm.

2. An exciter for a panel-type loud speaker in accordance with claim 1, further comprising a yieldable member to be placed between and in contact with said three-layer embedded section and said diaphragm.

3. An exciter for a panel-type loud speaker in accordance with claim 1, in which said mounting protrusion has at said distal end thereof a plate-shaped portion extending from said distal end toward an other end of said bimorph in the longitudinal direction thereon and in parallel with said bimorph end holding portion and said bimorph, the plate-shaped portion being adapted to be attached to said diaphragm so that said bimorph is spaced apart from said diaphragm.

4. An exciter for a panel-type loud speaker in accordance with claim 3, further comprising a yieldable member to be placed between and in contact with said three-layer embedded section and said plate-shaped portion.

5. An exciter for a panel-type loud speaker, comprising:

a bimorph and a bimorph holding member, said bimorph comprising:

an elongated plate member having opposite sides; and a pair of elongated piezoelectric ceramic layers, each formed on said opposite sides of said plate member, wherein said plate member includes an extension which is positioned in one end of said bimorph in a longitudinal direction thereof and extends longitudinally beyond said pair of piezoelectric ceramic layers sandwiching said plate member therebetween, and said bimorph holding member comprising:

a bimorph end holding portion for holding said one end of said bimorph, which comprises:

a three-layer embedded section embedding said pair of piezoelectric ceramic layers and said plate member sandwiched therebetween at said one end of said bimorph, and an extension embedded section in which said extension of said plate member is embedded except for a tip end thereof, which extends out of the extension embedded section; and a mounting protrusion protruding from said bimorph end holding portion, which comprises:

a flange portion extending radially outwardly from and circumferentially around said extension embedded section at a position longitudinally apart from said three-layer embedded section by a predetermined distance and adjacent to said tip end of said extension of said plate member; and a rectangular cylindrical portion extending from an outer peripheral edge of said flange portion toward an other end of said bimorph in the longitudinal direction thereof with a rectangular cylindrical space surrounded by the rectangular cylindrical portion and said extension embedded section, said three-layer embedded section and said bimorph, wherein said cylindrical portion is adapted to be fixed to a diaphragm of a panel-type loud speaker.

6. An exciter for a panel-type loud speaker in accordance with claim 5, further comprising a yieldable member to be placed between and in contact with said three-layer embedded section and an interior wall surface of said rectangular cylindrical portion.

7. A panel-type loud speaker comprising a flat diaphragm and an exciter attached to said diaphragm, said exciter comprising a bimorph and a bimorph holding member, said bimorph comprising:

an elongated plate member having opposite sides; and a pair of elongated piezoelectric ceramic layers, each formed on said opposite sides of said plate member, wherein said plate member includes an extension which is positioned at one end of said bimorph in a longitudinal direction thereof and extends longitudinally beyond said pair of piezoelectric ceramic layers sandwiching said plate member therebetween;

said bimorph holding member comprising:

a bimorph end holding portion for holding said one end of said bimorph, which comprises:

a three-layer embedded section embedding said pair of piezoelectric ceramic layers and said plate member sandwiched therebetween at said one end of said bimorph, and an extension embedded section in which said extension of said plate member is embedded except for a tip end thereof, which extends out of the extension embedded section; and a mounting protrusion protruding from said bimorph end holding portion, wherein said mounting protrusion comprises:

a proximal end connected to said extension embedded section at a position longitudinally apart from said three-layer embedded section by a predetermined distance and adjacent to said tip end of said extension of said plate member, and a distal end adapted to be connected to a diaphragm of a panel-type loud speaker so that said bimorph is positioned with a space interposed between said bimorph and said diaphragm.

8. A panel-type loud speaker in accordance with claim 7, further comprising a yieldable member to be placed between and in contact with said three-layer embedded section and said diaphragm.

9. An exciter for a panel-type loud speaker in accordance with claim 7, in which said mounting protrusion has at said distal end thereof a plate-shaped portion extending from said distal end toward an other end of said bimorph in the longitudinal direction thereon and in parallel with said bimorph end holding portion and said bimorph, the plate-shaped portion being adapted to be attached to said diaphragm so that said bimorph is spaced apart from said diaphragm.

10. A panel-type loud speaker in accordance with claim 9, further comprising a yieldable member to be placed between and in contact with said three-layer embedded section and said plate-shaped portion.

11. A panel-type loud speaker comprising a flat diaphragm and an exciter attached to said diaphragm, said exciter comprising a bimorph and a bimorph holding member, said bimorph comprising:

an elongated plate member having opposite sides; and a pair of elongated piezoelectric ceramic layers, each formed on said opposite sides of said plate member, wherein said plate member includes an extension which is positioned at one end of said bimorph in a longitudinal direction thereof and extends longitudinally beyond said pair of piezoelectric ceramic layers sandwiching said plate member therebetween, and said bimorph holding member comprising:

a bimorph end holding portion for holding said one end of said bimorph, which comprises:

a three-layer embedded section embedding said pair of piezoelectric ceramic layers and said plate member sandwiched therebetween at said one end of said bimorph, and an extension embedded section in which said extension of said plate member is embedded except for a tip end thereof, which extends out of the extension embedded section; and a mounting protrusion protruding from said bimorph end holding portion, which comprises:

a flange portion extending radially outwardly from and circumferentially around said extension embedded section at a position longitudinally apart from said three-layer embedded section by a predetermined distance and adjacent to said tip end of said extension of said plate member; and a rectangular cylindrical portion extending from an outer peripheral edge of said flange portion toward an other end of the bimorph in the longitudinal direction thereof with a cylindrical space surrounded by an interior wall surface of said cylindrical portion and said extension embedded section, said three-layer embedded section and said bimorph, wherein said rectangular cylindrical portion is adapted to be fixed to a diaphragm of a plate-type loud speaker.

12. A panel-type loud speaker in accordance with claim 11, further comprising a yieldable member placed between and in contact with said three-layer embedded section and the interior wall surface of said rectangular cylindrical portion.

* * * * *

UNITED STATES PATENT AND TRADEMARK OFFICE

CERTIFICATE OF CORRECTION

PATENT NO. : 7,764,804 B2
APPLICATION NO. : 11/514652
DATED : July 27, 2010
INVENTOR(S) : Yoshizumi Ota et al.

It is certified that error appears in the above-identified patent and that said Letters Patent is hereby corrected as shown below:

On the Title Page

Item (12), replace "Ohta et al." with --Ota et al.--.

Item (75), replace "Ohta" with --Ota--.

Item (75), replace "Fujiyoshida" with --Fujiyoshida-shi-- (both instances).

Signed and Sealed this

Sixteenth Day of November, 2010

David J. Kappos

David J. Kappos
*Director of the United States Patent and Trademark Office*